US009771677B1

(12) United States Patent
Yu et al.

(10) Patent No.: US 9,771,677 B1
(45) Date of Patent: Sep. 26, 2017

(54) DRYER APPLIANCES WITH IMPROVED HEATERS

(71) Applicant: General Electric Company, Schenectady, NY (US)

(72) Inventors: Zhiquan Yu, Mason, OH (US); Timothy Lee Anderson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1 day.

(21) Appl. No.: 15/064,646

(22) Filed: Mar. 9, 2016

(51) Int. Cl.
*D06F 58/26* (2006.01)
*D06F 58/02* (2006.01)

(52) U.S. Cl.
CPC ..... *D06F 58/26* (2013.01); *D06F 58/02* (2013.01)

(58) Field of Classification Search
CPC ..... D06F 58/02; D06F 58/26
USPC ..... 34/595–610
See application file for complete search history.

(56) References Cited

U.S. PATENT DOCUMENTS 3,269,027 A * 8/1966 Harnden, Jr. ..... D06F 58/28 34/547
3,541,293 A * 11/1970 Frienier ..... F27B 5/14 219/390
4,857,707 A * 8/1989 Dall ..... H05B 3/32 219/523
5,134,270 A * 7/1992 Bragg ..... D06F 58/26 219/532
5,713,138 A * 2/1998 Rudd ..... F26B 13/14 34/124
6,108,940 A * 8/2000 St. Louis ..... D06F 58/02 219/465.1
6,223,452 B1 * 5/2001 Hamand ..... D06F 58/04 34/267
7,017,282 B2 * 3/2006 Pyo ..... D06F 58/24 34/596
7,526,879 B2 * 5/2009 Bae ..... D06F 58/206 34/239
7,992,322 B2 * 8/2011 Kim ..... D06F 58/04 126/85 B
8,371,040 B2 * 2/2013 Kohne ..... D06F 58/20 34/443
8,627,581 B2 * 1/2014 Brown ..... D06F 58/02 34/603
9,057,153 B2 * 6/2015 Yu ..... D06F 58/10
9,243,844 B2 * 1/2016 Yu ..... F26B 21/004
9,371,609 B2 * 6/2016 Anderson ..... D06F 58/28
9,416,475 B2 * 8/2016 Kulkarni ..... D06F 25/00
9,493,903 B2 * 11/2016 Yu ..... F04D 29/282
9,518,354 B2 * 12/2016 Kulkarni ..... D06F 58/28
9,617,678 B2 * 4/2017 Yu ..... D06F 58/20
(Continued)

FOREIGN PATENT DOCUMENTS

CN 103966814 A 8/2014
JP H02265596 A1 10/1990

*Primary Examiner* — Stephen M Gravini
(74) *Attorney, Agent, or Firm* — Dority & Manning, P.A.

(57) ABSTRACT

A dryer appliance includes a cabinet defining an interior, and a drum positioned within the interior. The drum defines a chamber for receipt of articles for drying, and includes a cylinder and a rear wall. The cylinder is rotatable relative to the rear wall. The dryer appliance further includes a heater configured to provide heat to the chamber, the heater comprising a heating element mounted to the rear wall.

10 Claims, 3 Drawing Sheets

(56) References Cited

U.S. PATENT DOCUMENTS

2005/0252033 A1* 11/2005 Loesch ..... D06F 58/26
34/604
2017/0037563 A1* 2/2017 Kulkarni ..... D06F 58/28

* cited by examiner

DRYER APPLIANCES WITH IMPROVED HEATERS

FIELD OF THE INVENTION

The present subject matter relates generally to dryer appliances, and more particularly to dryer appliances which include improved heaters.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Typical dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower (also known as an air handler) is utilized to flow the internal air from the vent duct to the exhaust duct. When operating, the blower may pull air through itself from the vent duct, and this air may then flow from the blower to the exhaust conduit.

One concern with presently known dryer appliances is the power consumption and high temperature production of known heaters utilized with the dryer appliances. For example, some known heaters operate at greater than 5000 Watts, and can consume in excess of 2200 Watt-Hours when drying loads using U.S. Department of Energy uniform test procedures. Additionally, increasingly high temperature production can in some cases present safety concerns.

Accordingly, improved heaters for use with dryer appliances are desired in the art. In particular, heaters which produce required heat for drying purposes while reducing power consumption and maximum temperatures would be advantageous.

BRIEF DESCRIPTION OF THE INVENTION

In accordance with one embodiment of the present disclosure, a dryer appliance is provided. The dryer appliance includes a cabinet defining an interior, and a drum positioned within the interior. The drum defines a chamber for receipt of articles for drying, and includes a cylinder and a rear wall. The cylinder is rotatable relative to the rear wall. The dryer appliance further includes a heater configured to provide heat to the chamber, the heater comprising a heating element mounted to the rear wall.

In accordance with another embodiment of the present disclosure, a dryer appliance is provided. The dryer appliance includes a cabinet defining an interior, and a drum positioned within the interior. The drum defines a chamber for receipt of articles for drying, and includes a cylinder and a rear wall. The cylinder is rotatable relative to the rear wall. The dryer appliance further includes a heater mounted to the rear wall and configured to provide heat to the chamber. The heater includes a resistive heating element embedded in a flexible substrate. The heater has a maximum power of less than 2000 Watts.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
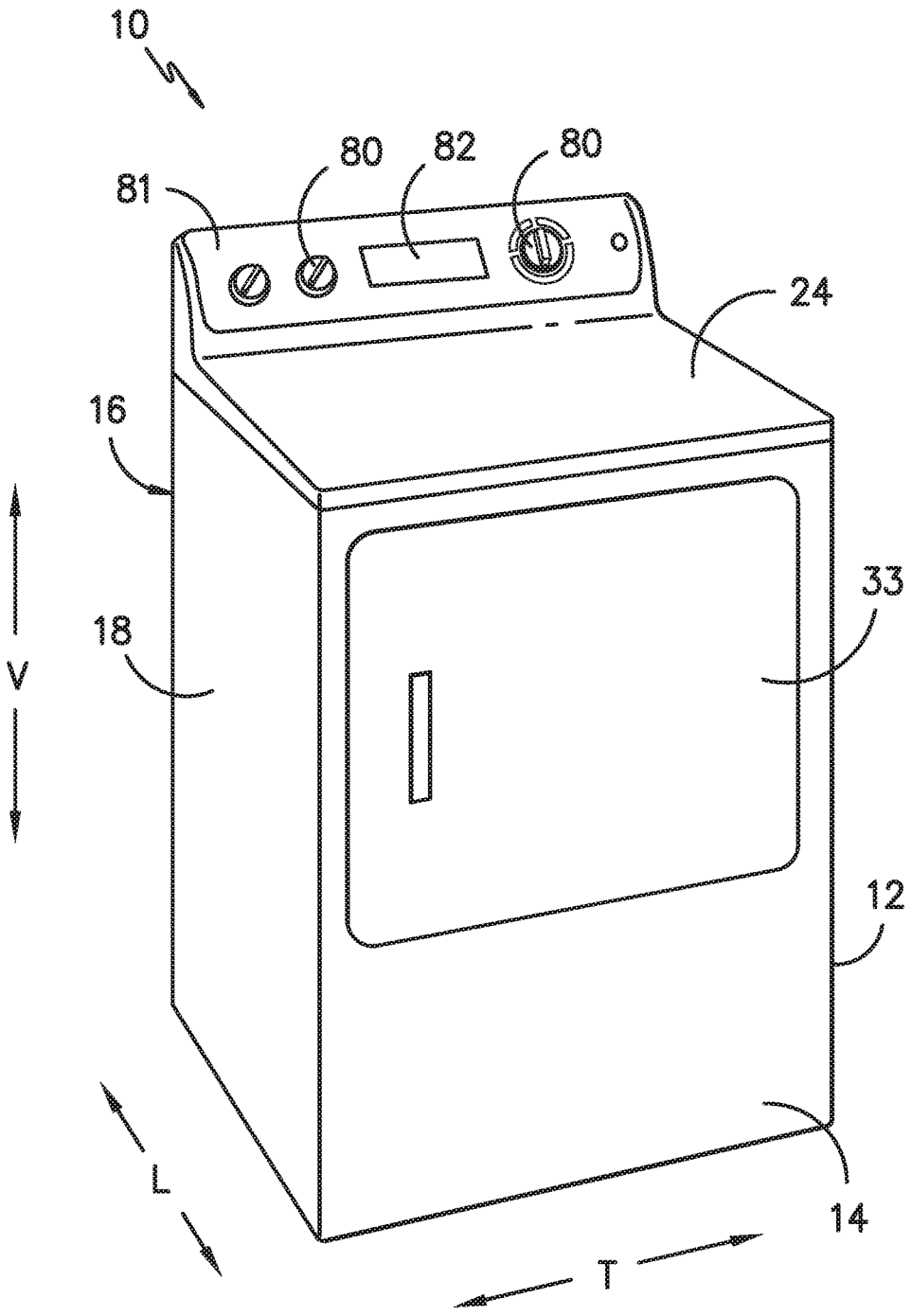
FIG. 1 provides a perspective view of a dryer appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
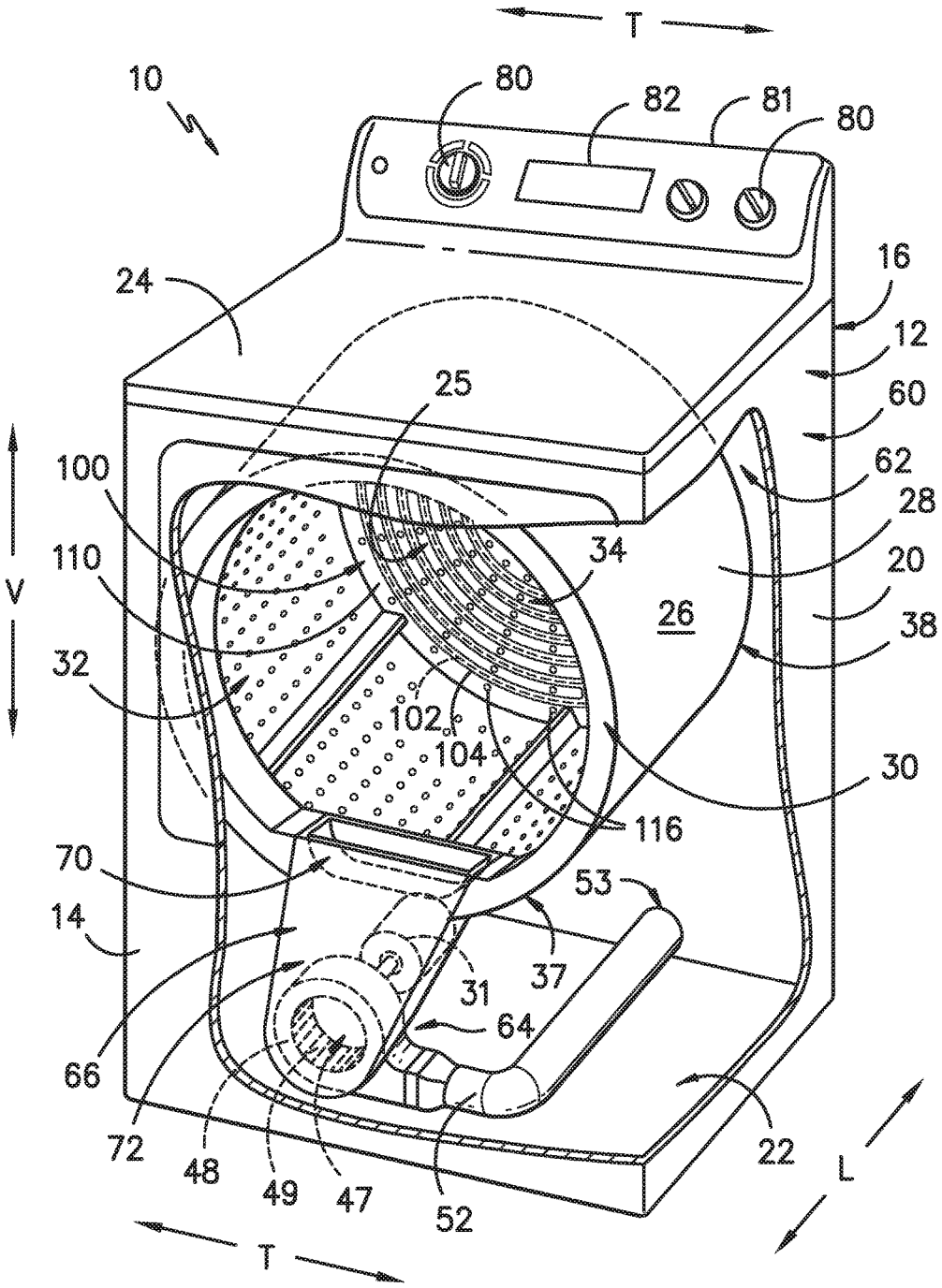
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. As is generally understood, the rear wall 34 remains generally stationary during operation of the dryer appliance 10. The cylinder 28 (and wall 30) are rotatable relative to the drum 26, such as about a central longitudinal axis of the cylinder 28 which in exemplary embodiments as shown extends parallel to the lateral direction L. In alternative embodiments, entry 32 may be defined in top cover 24 and cylinder 28, and front wall 30 may be a generally solid wall.

A motor 31 may be in mechanical communication with a blower or air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

As discussed herein, drum 26 may be configured to receive heated air that has been heated by a heater, e.g., in order to dry damp articles disposed within chamber 25 of drum 26. As discussed above, during operation of dryer appliance 10, motor 31 rotates fan 49 of air handler 48 such that air handler 48 draws air through chamber 25 of drum 26. Ambient air that is heated by the heater may thus be drawn into chamber 25 of drum 26. Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66 and an exhaust conduit 52. The exhaust conduit 52 is in fluid communication with the vent duct 66. During a dry cycle, internal air flows from the chamber 25 through the vent duct 66 to the exhaust conduit 52, and is exhausted from the exhaust conduit 52. As shown, the internal air can for example flow from the vent duct 66 through an exit conduit 47 defined in the vent duct 66 and air handler 48 to the exhaust conduit 52.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and to the exhaust conduit 52, such as through the exit conduit 47.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate the motor 31 and heaters (discussed herein) in response to the position of selector knobs 80. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

It should be understood that, while FIGS. 1 and 2 illustrate embodiments wherein dryer assembly 10 is a horizontal axis dryer assembly, in other embodiments dryer assembly 10 may be, for example, a vertical axis dryer assembly or another suitable dryer assembly. In a vertical axis dryer assembly 10, for example, cylinder 28 of drum 26 may extend along the vertical axis V between rear wall 34 and front wall 30. Accordingly, the present disclosure is not limited to horizontal axis dryer assemblies. Rather, any suitable dryer assembly is within the scope and spirit of the present disclosure.

Figure 3:
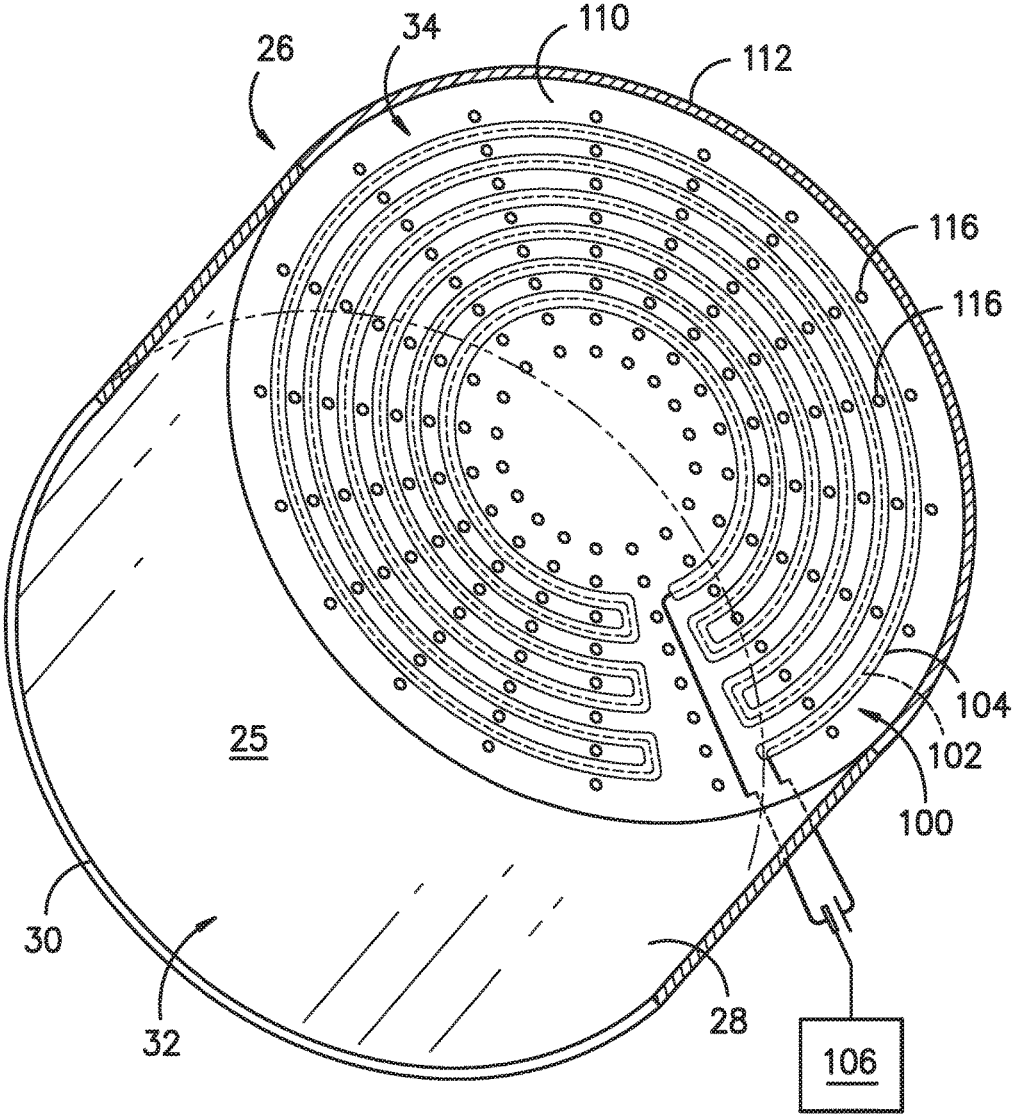
FIG. 3 provides a perspective view of a drum of a dryer appliance with a heater mounted thereto in accordance with embodiments of the present disclosure.

Referring now to FIG. 3, a heater 100 for a dryer appliance 10 in accordance with the present disclosure is provided. Heater 100 is configured to provide heat to the chamber 25, such as via activation of one or more heating elements 102 of the heater 100 and resulting generation of heat. As discussed, this generated heat may heat ambient air being flowed into the chamber 25.

Heater 100, and the heating element(s) 102 thereof, may be mounted to the rear wall 34. In particular, the heater 100 may be directly mounted to the rear wall 34, such that the heater 100 is in contact with a surface of the rear wall 34. While in some embodiments the heating elements 102 are in contact with a surface of the rear wall 34, in exemplary embodiments a substrate 104 is provided in which the heating elements 102 are embedded. The substrate 104 may be in contact with a surface of the rear wall 34, or an adhesive or other mounting material/component may be disposed between the substrate 104 and the surface of the rear wall 34 to mount the heater 100 to the rear wall 34.

In exemplary embodiments, the substrate 104 may be flexible. For example, the heater 100 in exemplary embodiments may be a flexible film heater, and thus the substrate 104 thereof may be significantly deformable (i.e. greater than 10%, greater than 20%, greater than 30%, greater than 40%, greater than 50%, greater than 60%, or greater than 70% bending) without cracking or breaking. Substrate 104 may, for example, be formed from a polyimide, silicone, fiberglass, or other suitable elastomeric or otherwise flexible material.

In exemplary embodiments, a heating element 102 in accordance with the present disclosure may be a resistive heating element, such as a resistive wire as shown or another suitable element that generates heat due to resistance as an electric current is passed through the heating element. Resistive heating elements (or other suitable heating elements) may be formed from suitable metals, ceramics, polymers, or other suitable materials. In exemplary embodiments, the heating element(s) 102 may be connected to a power source 106, such as an electrical power source to receive electricity for heat generation purposes.

As discussed, the heater 100 (and heating element(s) 102 and substrate 104 thereof) is mounted to the rear wall 34. Rear wall 34 may include an inner surface 110 and an opposing outer surface 112. The inner surface 110 may (along with, for example, an inner surface of the drum 26) define the chamber 25. In exemplary embodiments, the heater 100 (and heating element(s) 102 and substrate 104 thereof) is mounted to the inner surface 110. Additionally or alternatively, however, a heater 100 (and heating element(s) 102 and substrate 104 thereof) may be mounted to the outer surface 112.

In exemplary embodiments, a plurality of perforations 116 may be defined in the rear wall 34. Perforations 116 may each extend between and be defined in the inner and outer surfaces 110, 112, to allow air to flow therethrough from exterior of the chamber 25 into the chamber 25. As discussed above, operation of air handler 48 may cause such flow of air. In exemplary embodiments, a plurality of annularly arranged, radially extending rows of perforations 116 may be provided and defined as illustrated. Alternatively, other suitable arrangements of perforations 116 may be provided.

In exemplary embodiments, heater 100 may be disposed between the perforations 116, such that the heater 110 does not cover the perforations 116 and thus does not block air flow through the perforations 116. Air flow through the perforations 116 may be heated by the heat generated from the heater 100, and this air may be utilized within the chamber 25 to dry the articles therein, i.e. advantageously via both convective and conductive heat transfer. In exemplary embodiments, for example, the air may flow into the chamber 25 through perforations 116, and then be heated by the heater 100 mounted to the inner surface 110.

Heaters 100 in accordance with the present disclosure can advantageously provide sufficient, and in exemplary embodiments improved, drying of articles while reducing the overall power consumption and high temperature generation of the associated dryer 10. For example, in exemplary embodiments, the heater 100 may have a maximum power of less than 2000 Watts, such as less than 1500 Watts, such as less than 1200 Watts. Further, the total energy consumption of the dryer 10 when utilizing heaters 100 may be reduced. Total energy consumption, as measured in Watt-Hours, can for example be measured using U.S. Department of Energy Uniform Test Method. One such test method is provided at 10 C.F.R. Section 430 Appendix D1 (as of Feb. 3, 2016), which is incorporated by reference herein. In exemplary embodiments, a total energy consumption for heater 100 for a load dried using the U.S. Department of Energy Uniform Test Method at 10 C.F.R. Section 430 Appendix D1 (as of Feb. 3, 2016) is less than 2000 Watt-Hours, such as less than 1900 Watt-Hours, such as less than 1800 Watt-Hours.

Further, in exemplary embodiments, the maximum temperature within the chamber 25 during operation of the dryer appliance 10 may be reduced relative to conventional dryers, and may for example be less than 240 degrees, such as less than 220 degrees, such as less than 200 degrees.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior;

a drum positioned within the interior, the drum defining a chamber for receipt of articles for drying, the drum comprising a cylinder and a rear wall, the cylinder rotatable relative to the rear wall;

a heater configured to provide heat to the chamber, the heater comprising a heating element mounted to the rear wall; and a flexible substrate comprising a polyamide or a silicone mounted to the rear wall, wherein the heater is embedded in the flexible substrate, wherein a plurality of perforations are defined in the rear wall, the perforations of the plurality of perforations each extending from an inner surface of the rear wall to an outer surface of the rear wall, and wherein the heater is disposed on the inner surface of the rear wall between the perforations of the plurality of perforations along a radial direction such that the heater does not cover the perforations.

2. The dryer appliance of claim 1, wherein the heating element is a resistive heating element.

3. The dryer appliance of claim 1, wherein the heater has a maximum power of less than 2000 Watts.

4. The dryer appliance of claim 1, wherein the heater has a maximum power of less than 1500 Watts.

5. The dryer appliance of claim 1, wherein a total energy consumption for the heater for a load during a single cycle is less than 2000 Watt-Hours.

6. The dryer appliance of claim 1, wherein a maximum temperature within the chamber during operation of the dryer appliance is less than 240 degrees Fahrenheit.

7. A dryer appliance, comprising:

a cabinet defining an interior;

a drum positioned within the interior, the drum defining a chamber for receipt of articles for drying, the drum comprising a cylinder and a rear wall, the cylinder rotatable relative to the rear wall; and a heater mounted to the rear wall and configured to provide heat to the chamber, the heater comprising a resistive heating element embedded in a flexible substrate comprising a polyamide or a silicone, wherein the heater has a maximum power of less than 2000 Watts wherein a plurality of perforations are defined in the rear wall, the perforations of the plurality of perforations each extending from an inner surface of the rear wall to an outer surface of the rear wall, and wherein the heater is disposed on the inner surface of the rear wall between the perforations of the plurality of perforations along a radial direction such that the heater does not cover the perforations.

8. The dryer appliance of claim 7, wherein the heater has a maximum power of less than 1500 Watts.

9. The dryer appliance of claim 7, wherein a total energy consumption for the heater for a load during a single cycle is less than 2000 Watt-Hours.

10. The dryer appliance of claim 7, wherein a maximum temperature within the chamber during operation of the dryer appliance is less than 240 degrees Fahrenheit.

* * * * *